US005415992A

United States Patent [19]

Lok

[11] Patent Number: 5,415,992

[45] Date of Patent: May 16, 1995

[54] HEAT STABILIZED SILVER CHLORIDE PHOTOGRAPHIC EMULSIONS CONTAINING PHOSPHINE COMPOUNDS

[75] Inventor: Roger Lok, Rochester, N.Y.

[73] Assignee: Eastman Kodak Company, Rochester, N.Y.

[21] Appl. No.: 159,354

[22] Filed: Nov. 30, 1993

[51] Int. Cl.[6] ..... G03C 1/34

[52] U.S. Cl. ..... 430/610; 430/569; 430/600; 430/601; 430/603; 430/611

[58] Field of Search ..... 430/610, 601, 611, 613, 430/600, 603, 569

[56] References Cited

U.S. PATENT DOCUMENTS

| | | | |
|---|---|---|---|
| T864,011 | 7/1969 | Herz | 96/108 |
| T866,036 | 9/1969 | Kalenda et al. | 96/109 |
| 2,385,762 | 9/1945 | Mueller | 95/7 |
| 2,394,198 | 2/1946 | Mueller | 95/7 |
| 2,440,110 | 4/1948 | Mueller | 95/7 |
| 3,042,521 | 7/1962 | Dersch et al. | 96/66 |
| 3,043,696 | 7/1962 | Herz et al. | 96/108 |
| 3,057,725 | 10/1962 | Herz et al. | 96/109 |
| 3,226,232 | 12/1965 | Dersch et al. | 96/61 |
| 3,297,446 | 1/1967 | Dunn | 96/107 |
| 3,301,678 | 1/1967 | Humphlett et al. | 96/61 |
| 3,397,986 | 8/1968 | Millikan et al. | 96/109 |
| 3,447,925 | 7/1969 | Dersch et al. | 96/66.5 |
| 3,759,901 | 7/1973 | Lincoln et al. | 260/240 G |
| 3,761,277 | 7/1973 | Vandenberghe et al. | 96/109 |
| 3,880,864 | 4/1975 | Lincoln et al. | 260/286 Q |
| 3,904,415 | 7/1975 | Oftedahl | 96/107 |
| 4,058,524 | 11/1977 | Leshin | 544/136 |
| 4,198,240 | 4/1980 | Mikawa | 430/611 |

(List continued on next page.)

FOREIGN PATENT DOCUMENTS

| | | |
|---|---|---|
| 138622 | 4/1985 | European Pat. Off. . |
| 293917 | 12/1988 | European Pat. Off. . |
| 294149 | 12/1988 | European Pat. Off. . |
| 297804 | 1/1989 | European Pat. Off. . |
| 327272 | 8/1989 | European Pat. Off. . |
| 348934 | 1/1990 | European Pat. Off. . |
| 349286 | 1/1990 | European Pat. Off. . |
| 358170 | 3/1990 | European Pat. Off. . |
| 368304 | 5/1990 | European Pat. Off. . |
| 369491 | 5/1990 | European Pat. Off. . |
| 371338 | 6/1990 | European Pat. Off. . |
| 434012 | 6/1990 | European Pat. Off. . |
| 435270 | 7/1991 | European Pat. Off. . |
| 435355 | 7/1991 | European Pat. Off. . |
| 439041 | 7/1991 | European Pat. Off. . |
| 447647 | 9/1991 | European Pat. Off. . |
| 495253 | 7/1992 | European Pat. Off. . |
| 3307506 | 9/1984 | Germany . |
| 54-069428 | 6/1979 | Japan . |
| 55-142331 | 11/1980 | Japan . |
| 62-299963 | 12/1987 | Japan . |
| 63-044650 | 2/1988 | Japan . |
| 3-208041 | 9/1991 | Japan . |
| 1295463 | 11/1972 | United Kingdom . |
| 92/12462 | 7/1992 | WIPO . |

*Primary Examiner*—Thorl Chea
*Attorney, Agent, or Firm*—Peter C. Cody

[57] ABSTRACT

A silver halide photographic element comprising a silver halide emulsion which is greater than 50 mole % silver chloride, said emulsion being in reactive association with a sulfur donating compound and a phosphine compound represented by Formulae I and II, and polymers having a repeating unit derived from the compounds of Formula I, Formula (I) $R^{18}R^{19}R^{20}P$ Formula (II) $R^{21}R^{22}P—A—PR^{23}R^{24}$ wherein $R^{18}$, $R^{19}$, $R^{20}$, $R^{21}$, $R^{22}$, $R^{23}$, and $R^{24}$ are independently alkyl, or aryl groups, or $R^{18}$, $R^{19}$, $R^{20}$, $R^{21}$, $R^{22}$, $R^{23}$, and $R^{24}$ may combine to form a 5 or 6-membered ring , and wherein A is a divalent carbon linking group, and a method of making the silver chloride emulsion.

18 Claims, No Drawings

U.S. PATENT DOCUMENTS

| | | | |
|---|---|---|---|
| 4,245,033 | 1/1981 | Eida et al. | 430/353 |
| 4,276,374 | 6/1981 | Mifune et al. | 430/611 |
| 4,346,154 | 8/1982 | McLaen et al. | 430/14 |
| 4,357,280 | 11/1982 | Chylewski et al. | 260/465 R |
| 4,396,707 | 8/1983 | von Konig et al. | 430/446 |
| 4,411,985 | 10/1983 | Morrow et al. | 430/352 |
| 4,451,557 | 5/1984 | Lok et al. | 430/505 |
| 4,511,644 | 4/1985 | Okamura et al. | 430/219 |
| 4,515,888 | 5/1985 | Beretta et al. | 430/584 |
| 4,547,452 | 10/1985 | Toya | 430/216 |
| 4,578,347 | 3/1986 | Philip, Jr. | 430/572 |
| 4,620,205 | 10/1986 | Iiyama et al. | 346/208 |
| 4,620,941 | 11/1986 | Yoshikawa et al. | 252/408.1 |
| 4,780,404 | 10/1988 | Sills et al. | 430/572 |
| 4,859,580 | 8/1989 | Aono et al. | 430/617 |
| 4,863,846 | 9/1989 | Tanaka et al. | 430/572 |
| 4,914,015 | 4/1990 | Philip, Jr. et al. | 430/572 |
| 4,960,689 | 10/1990 | Nishikawa et al. | 430/603 |
| 4,962,016 | 10/1990 | Chino et al. | 430/603 |
| 5,006,448 | 4/1991 | Szajewski et al. | 430/505 |
| 5,006,665 | 4/1991 | Rody et al. | 549/28 |
| 5,070,007 | 12/1991 | Rody et al. | 430/551 |
| 5,070,008 | 12/1991 | Maekawa et al. | 430/567 |
| 5,079,138 | 1/1992 | Takada | 430/567 |
| 5,082,766 | 1/1992 | Nishijima et al. | 430/551 |
| 5,084,376 | 1/1992 | Suda et al. | 430/617 |
| 5,091,294 | 2/1992 | Nishijima et al. | 430/505 |
| 5,229,263 | 7/1993 | Yoshida et al. | 430/600 |
| 5,356,770 | 10/1994 | Lok et al. | 430/611 |

HEAT STABILIZED SILVER CHLORIDE PHOTOGRAPHIC EMULSIONS CONTAINING PHOSPHINE COMPOUNDS

FIELD OF THE INVENTION

This invention relates to the use of addenda in silver halide photographic elements to improve heat stability.

BACKGROUND OF THE INVENTION

Photofinishers that use photosensitive paper to produce color prints desire short processing times in order to increase output. One way of obtaining rapid processing is to accelerate the development time by increasing the chloride content of the emulsions used in the photographic paper. However, as the chloride content of a photographic emulsion is increased, it becomes more difficult to obtain good invariant photosensitivity.

One of the problems with silver chloride emulsions is their severe propensity to storage deterioration. Photographic emulsions that have a high silver chloride content are prone to fog increase due to high temperature and humidity during storage. These changes may vary from layer to layer resulting in color imbalance and a loss of quality of the print material. Attempts have been made to reduce fog formation during storage by addition of inhibitory agents to the silver halide emulsions. For example, U.S. Pat. Nos. T866,036; 2,440,110; 3,043,696; 3,057,725; 3,226,232; 3,397,986; 3,447,925; and 3,761,277 describe the addition of organic disulfides to silver halide emulsions to lessen the tendency towards fog growth.

High chloride content color print paper also has an undesirable sensitivity to temperature changes during exposure. For example, when the temperature upon exposure rises due to heat from the exposing element during printing, the print density changes if the printing conditions are left at the initial set values. This may result in prints varying in density that were exposed at the normal temperature. This density difference contributes to print variability and is not acceptable to photofinishers. Very often, an increase in temperature during exposure of the paper may result in a selective increase in speed in one layer, for instance the cyan layer, over another light sensitive layer such as the magenta layer. This results in improper color balance of the color print, and requires the photofinisher to readjust his printing conditions in order to compensate for this density fluctuation. This results in a loss in operating efficiency.

This deficiency in the use of high silver chloride color paper material is recognized in the art. In particular, EP 0 367,227 (1988) discusses reducing heat sensitivity by employing certain spectral sensitizing dyes in combination with mercapto azoles. However, these dye structures have not proved to be entirely satisfactory in terms of minimizing thermal sensitivity while still maintaining optimal sensitization efficiency. EP 0 325,235 describes using iron ion donating compounds in high chloride photographic elements to reduce their change in sensitivity due to exposure at elevated temperature. Despite these attempts to address the thermal problem, no solution has been found which completely eliminates the above concerns.

Phosphines are trivalent phosphorous compounds which have been described for use in silver halide emulsions. U.S. Pat. No. 4,515,888 describes using triphenyl phosphines and certain amidinium cyanine dyes to supersensitize an infrared sensitive silver halide emulsion. U.S. Pat. No. 4,578,347 describes a supersensitizing effect obtained from the use of water soluble triaryl phosphines in infrared sensitive silver halide emulsions. U.S. Pat. No. 4,346,154 describes using triaryl phosphines in an undercoat layer to retard stain formed from a post-process buildup of silver sulfide. U.S. Pat. No. 3,297,446 describes using a selenium sensitizer in an emulsion that also contains an antifogging amount of a tertiary phosphine antifoggant. U.S. Pat. No. 4,357,280 describes using water soluble phosphines to accelerate the bleaching of dye and silver in processing baths. Certain tris(dialkylamino)phosphines are described in U.S. Pat. No. 3,904,415 as having a sensitizing effect in silver bromide or silver bromoiodide emulsions. Russian Patent 195,872 discloses triphenyl phosphines to be useful sensitizers in silver halide emulsions. GB 1,295,463 teaches that silver halide emulsions can be sensitized through the use of gelatin which has been treated with phosphine. GB 1,066,261 teaches using phosphino aryl sulfonic acid salts as antifoggants in silver halide emulsions. None of these references describes using phosphine compounds to stabilize a photographic element against thermal changes during exposure.

Compounds with labile sulfur moieties have been extensively used as sensitizers of silver halide emulsions. Their use and mechanism of action have been discussed in the photographic art such as by Pouradier, *J. Properties of Gelatin in Relation to Its Use in the Preparation of Photographic Emulsions;* James, T. H. Ed.; The Theory of the Photographic Process, 4th ed.; Macmillan: New York, 1977, Chapter 2; by Duffin, G. F. *Photographic Emulsion Chemistry; Focal:* London, 1966, Chapter 2 and by Mueller, F. W. H. in *The Photographic Emulsion,* Sturge, J. M. Ed.; Neblette's Handbook of Photographic and Reprography, 7th ed.; Van Nostrand Reinhold: New York, 1977, Chapter 2. Common among these labile sulfur compounds are thionates, thioureas, thiosulfates, isothiocyanates and sulfur containing amino acids such as cystine.

Elemental sulfur (also known as inorganic sulfur) has been claimed to be useful in silver halide photographic emulsions. EP 0 447,105; EP 0 297,804; EP 0 294,149 (AgCl); EP 0 327,272; EP 0 349,286; JP 2,161,423; JP 2,148,033; JP 2,148,031; JP 2,146,036; JP 0 2,033,141; JP 2,020,857; JP 2,301,744; JP 1,196,050; JP 1,196,034; DE 3,902,711; and U.S. Pat. No. 4,962,016, describe the use of elemental sulfur for sensitizing silver halide emulsions.

Thiatriazoles have been used as supersensitizers for silver halide photographic materials as described in U.S. Pat. No. 4,914,015 (substituted thia and oxa thiatriazoles in red and infrared spectrally sensitized emulsions); U.S. Pat. No. 4,780,404 (amino thiatriazoles); EP 0 447,647 (arylaminothiatriazoles substituted with at least one electron-withdrawing group); and JP 3,033,842 and JP 3,041,438, (thiatriazoles as supersensitizers in red sensitized silver halide emulsions). JP 63/037,348 describes using thiatriazoles in silver chloride emulsions to obtain a low D-min photographic material. JP 63/044,650 and JP 63/037,349 describe a high storage stability material. U.S. Pat. No. 5,070,008 describes using thiatriazoles in silver chloride emulsions with iridium and acidic conditions for formation of AgCl grains. JP 80/142,331 describes using a thiatriazole in a photothermographic paper to reduce fog. U.S. Pat. No. 5,006,448 describes using a thiatriazole as an inhibitor fragment that is released for improving interimage effects.

Pyrazolopentathiepins have been described as fungicides or as sulfur sensitizers in photographic emulsions in EP 0 138,622. In JP 62/299,963 thiepin is mentioned as an example of a class of compounds used for the preparation of silver halide emulsions which comprises at least 50 mol % of silver bromide.

U.S. Pat. No. 4,960,689 describes using thiosulfonates in the finish in high Cl emulsions. Aromatic dithiosulfonic acids are described in U.S. Pat. No. 5,009,992 as supersensitizers in an IR-sensitive high Cl emulsion. WO 92/12,462 describes using thiosulfonates and sulfinates in controlling speed increase on incubation of color photographic materials. The combination of thiosulfonates with sulfinates has been used in the sensitization of chloride emulsions for color paper in JP 3,208,041. U.S. Pat. No. 2,394,198 discloses the use of sulfinates with thiosulfonates in stabilizing silver halide emulsions.

U.S. Pat. No. 2,385,762 describes using diamino disulfides and sufinates to stabilize silver halide emulsions. U.S. patent application Ser. No. 07/890,884 describes using diamino disulfides and sulfinates to reduce the thermal sensitivity of high chloride emulsions.

There remains a continuing need for an effective means for heat stabilizing high chloride emulsions against thermal changes.

SUMMARY OF THE INVENTION

This invention provides a silver halide photographic element comprising a silver halide emulsion which is greater than 50 mole % silver chloride, said emulsion being in reactive association with a sulfur donating compound and a phosphine compound represented by Formulae I and II, and polymers having a repeating unit derived from the compounds of Formula I, Formula (I) $R^{18}R^{19}R^{20}P$ Formula (II) $R^{21}R^{22}P—A—PR^{23}R^{24}$ wherein $R^{18}$, $R^{19}$, $R^{20}$, $R^{21}$, $R^{22}$, $R^{23}$, and $R^{24}$ are independently alkyl, or aryl groups, or $R^{18}$, $R^{19}$, $R^{20}$, $R^{21}$, $R^{22}$, $R^{23}$, and $R^{24}$ may combine to form a 5 or 6-membered ring, and wherein A is a divalent carbon linking group. This invention further provides a method of making the above described photographic emulsion.

The high chloride silver halide photographic elements of this invention exhibit very little variation in sensitivity upon changes in printing temperatures, while maintaining high resistance to storage changes. This allows for high quality prints without the need for constant readjustment of printing conditions during processing.

DETAILED DESCRIPTION OF THE INVENTION

The sulfur donating compounds of this invention are those materials that extrude elemental sulfur on decomposition. Elemental sulfur is a form of sulfur that is zero valent and non-ionic. It is generally, but not always, expelled from the parent compound through a thermal process. That is, a myriad of other reactions, such as catalysis, and/or hydrolysis may take place, with the end result being that elemental sulfur is extruded from the parent molecule, sometimes known as the sulfur precursor. These compounds have been extensively reviewed in the published literature, see Loudon, J. D. *The Extrusion of Sulfur,* Kharasch, N. K. Ed. Organic Sulfur Compounds, Pergamon: Oxford, 1961, Vol. 1, p. 299; Stark, B. P. and Duke, A. J. *Extrusion Reactions,* Pergamon: Oxford, 1967, p. 91; Radl, S. Janssen Chim Acta, 1987, 5, 3; Guziec, F. S. Jr and Sanfilippo, L. J. Tetrahedron, 1988, 44, 6241 and in Williams, C. R. and Harpp, D. N. Sulfur Reports, 1990, 10 (2), 103–191. Many of these compounds release elemental sulfur near or slightly above room temperature while others require temperatures as high as 200° C. or above. Still others require, in addition to high heat, presence of a trace metal for catalysis of the extrusion reaction. The preferred compounds of this invention are the ones that do not require a high temperature for extrusion, nor a specific catalyst or solvent, even though a catalytic reaction may take place in the silver halide emulsion to facilitate the extrusion reaction. More preferable are the compounds that will extrude sulfur below 200° C., and are stable at room temperature.

Examples of such sulfur donating compounds are certain disulfides, polysulfides, bis-alkylamino disulfides, sulfinic, sulfonic thioanhydrides, thiosulfonate salts, aminothiosulfonates, acylmethylmercapto azoles or azolium salts, thiazepines, thiepins, 1,4-dithiins, 1,2-, 1,3-, or 1,4-thiazines, 1,4,2-dithiazines, 1,3,4-, 1,2,6-, 1,3,5-thiadiazines, dihydro derivatives of dithiazines or thiadiazines, and 1,2,3,4-thiatriazoles. Vulcanizing agents such as those discussed by Porter, M. in *Vulcanization of Rubber;* Oae, S. Ed.; Organic Chemistry of Sulfur; Plenum: New York, 1977, Chapter 3, and by Hofmann, W. *Vulcanization and Vulcanizing Agents;* Palmerton: New York, 1967 may also be effective. They include thiuram tetrasulfides, benzothiazolyl-2-N-dithiomorpholide, and di-morpholino disulfide. Elemental sulfur when appropriately dissolved in alcoholic solvents may also be useful. The following classes of sulfur donating compounds are particularly useful.

The acylmethylmercapto azolium salts are represented by Formula (A)

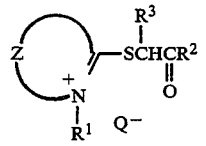

(A)

In the above structure, Z contains the atoms necessary to form either a 5 or 6-membered fused or non-fused heterocyclic ring. Preferred heteroatoms are nitrogen, oxygen and sulfur. Examples of suitable heterocyclic groups are pyrrole, pyridine, picoline, piperidine, morpholine, pyrrolidine, oxazole, thiazole, imidazole, triazole, tetrazole, thiadiazole, and oxadiazole. $R^1$ and $R^2$ are substituted or unsubstituted alkyl or aryl groups, more preferably, they are alkyl groups having 1 to 20 carbon atoms, with 1 to 6 carbon atoms being most preferred, or aryl groups having 6 to 10 carbons atoms, with 6 carbon atoms being most preferred. Examples of suitable substituents include alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups, cyano groups, sulfo groups, and amino groups. Preferred are simple alkyl groups.

$R^3$ is H, or an alkyl or aryl group as described for $R^1$ and $R^2$ and each may be further substituted as described for $R^1$ and $R^2$. Q is an anion which may be, for example, a halide, a perchlorate, a hexafluorophosphate, a tetrafluoroborate, an organic carboxylate or a sulfonateo Examples of these of salts are shown below:

A1

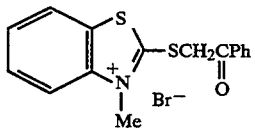

A2

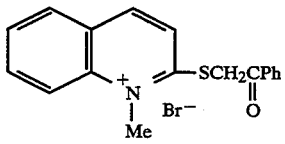

A3

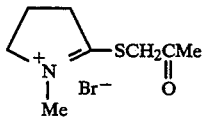

A4

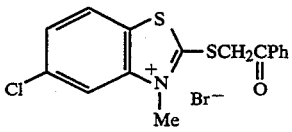

The thiepins are represented by Formula (B).

(B)

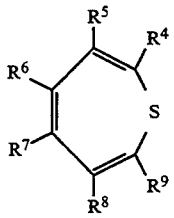

$R^4$, $R^5$, $R^6$, $R^7$, $R^8$ and $R^9$ are independently H $R^4$, $R^5$, $R^6$, $R^7$, $R^8$ and $R^9$ together may form fused or substituted or unsubstituted alkyl or aryl groups. $R^4$, $R^5$, $R^6$, $R^7$, $R^8$, and $R^9$ together may form fused rings. Preferably, the alkyl groups contain 1 to 20 carbon atoms, with 1 to 6 carbon atoms being most preferred, and the aryl groups contain 6 to 10 carbons atoms, with 6 carbon atoms being most preferred. Examples of suitable substituents include alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups, cyano groups, sulfo groups, and amino groups. Preferred are carboxy groups.

Examples of specific thiepin compounds are shown below.

B1

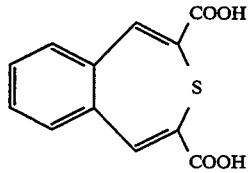

B2

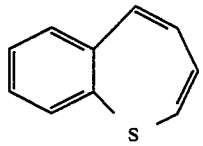

B3

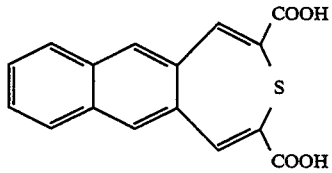

B4

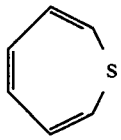

The 1,2,3,4-thiatriazoles are represented by Formula (C) below.

(C)

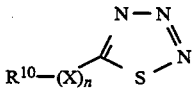

$R^{10}$ is a substituted or unsubstituted alkyl or aryl group, more preferably, an alkyl group having 1 to 20 carbon atoms, with 1 to 6 carbon being most preferred, or an aryl group having 6 to 10 carbons atoms, with 6 carbon atoms being most preferred. Examples of suitable substituents include alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups, cyano groups, sulfo groups, and amino groups. Preferred are hydroxy groups.

n may be 0 or 1. When n is 1, X is a heteroatom such as N, O or S. When the linking atom is N, there may be further substitution on the N such as described above for $R^{10}$. Specific examples of 1,2,3,4-thiatriazoles are shown below.

C1

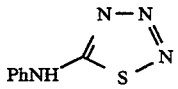

C2

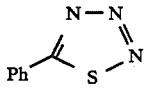

C3

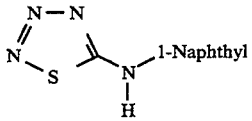

C4

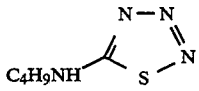

C5

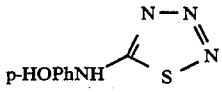

C6

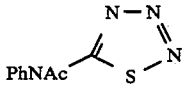

The aryldialkylamino disulfides are represented by Formula (D) below.

$ArSSNR^{11}R^{12}$ (D)

In Formula (D), one sulfur atom is bonded directly to a nitrogen atom and the other sulfur atom is bonded to a carbon atom which is part of an aromatic or heteroaromatic ring, Ar. When Ar is an aromatic group, it may be either a single ring or a condensed ring, preferably having 6 to 10 carbon atoms, and more preferably, having 6 carbon atoms. Examples of suitable aromatic groups include phenyl, tolyl, naphthyl, and cycloheptatrienyl. When Ar is a heteroaromatic ring, it may include, for example, pyrrole, pyridine, thiophene, quinoline, benzofuran, pyrazole, oxadiazole, thiadiazole, triazole, tetrazole, benzoxazole, benzothiazole, benzimidazole, or benzotriazole ring systems.

Ar may be further substituted or may be unsubstituted. Examples of suitable substituents include alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups, cyano groups, sulfo groups, and amino groups. Preferred are alkyl groups.

$R^{11}$ and $R^{12}$ are alkyl groups, or together they may form a ring. Examples of such rings include morpholine, piperidine, pyrazolidine, pyrrolidine, and imidazolidine rings. Preferably, the alkyl groups contain 1 to 20 carbon atoms, with 1 to 10 carbon being most preferred. $R^{11}$ and $R^{12}$ may be substituted as described for Ar.

Specific examples of aryldialkylamino disulfides are shown below.

D1

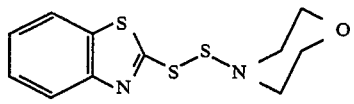

D2

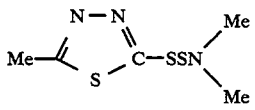

D3

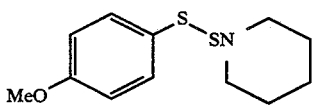

D4

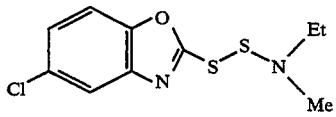

The thiosulfonate salts are represented by Formula (E) below.

$R^{13}SO_2SM$ (E)

$R^{13}$ is a substituted or unsubstituted alkyl, aryl, or heterocyclic group. Preferably, the alkyl groups contain 1 to 20 carbon atoms, with 1 to 10 carbon atoms being most preferred, and the aryl groups contain 6 to 10 carbons atoms, with 6 carbon atoms being most preferred. The heterocyclic group may be a 5 to 15-membered ring containing one or two heteroatoms. Preferred hetero atoms are nitrogen, sulfur and oxygen. More preferably, the heterocyclic group is a 5 or 6-membered ring. Examples of suitable aryl groups include phenyl, tolyl, naphthyl, and cycloheptatrienyl. Examples of suitable heterocyclic rings are pyrrole, furan, tetrahydrofuran, thiofuran, pyridine, picoline, piperidine, morpholine, pyrrolidine, thiophene, oxazole, thiazole, imidazole, triazole, tetrazole and oxadiazole. Preferably, $R^{13}$ is an unsubstituted phenyl group or a phenyl group substituted in one or two positions. Such substituents of $R^{13}$ may include, for example, alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups, cyano groups, sulfo groups, and amino groups. Preferred are alkyl or alkoxy groups. M is a cationic counter ion that may be an alkali metal or an ammonium ion.

Specific examples of thiosulfonate salts are illustrated below:

E1

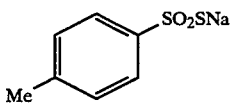

-continued

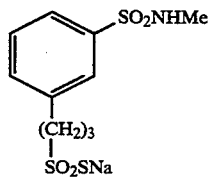

E2

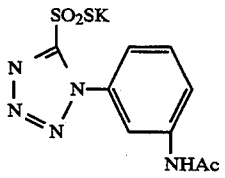

E3

$EtSO_2SNa$ E4

The diamino disulfides (also known as dithioamines) are represented by Formula (F) shown below.

$R^{14}R^{15}NSSNR^{16}R^{17}$ (F)

Each of the sulfur atoms of Formula (F) is bonded to each other and directly to a nitrogen atom. $R^{14}$, $R^{15}$, $R^{16}$, $R^{17}$ independently are hydrogen, or an alkyl, aryl, or heterocycle group or $R^{14}$, $R^{15}$, $R^{16}$, $R^{17}$ may form part of a ring system which may incorporate atoms such as S, O, or N. Examples of such ring systems include piperidine, morpholine, pyrrolidine and imidazolidine. Preferably, the alkyl groups contain 1 to 20 carbon atoms, with 1 to 10 carbon being most preferred, and the aryl groups contain 6 to 10 carbons atoms, with 6 carbon atoms being most preferred. The heterocyclic group may be a 5 to 15-membered ring containing one or two heteroatoms. The preferred heteroatoms are oxygen, nitrogen and sulfur. More preferably, the heterocyclic group is a 5 or 6-membered ring. Examples of suitable aryl groups include phenyl, tolyl, naphthyl, and cycloheptatrienyl. Examples of suitable heterocyclic groups are pyrrole, furan, tetrahydrofuran, thiofuran, pyridine, pyrrolidine, thiophene, oxazole, thiazole, imidazole, selenazole, tellurazole, triazole, tetrazole and oxadiazole.

Substituents of $R^{14}$, $R^{15}$, $R^{16}$, $R^{17}$ may include alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups, cyano groups, sulfo groups, and amino groups. Preferred are alkyl groups.

Specific examples of diaminodisulfides are illustrated below.

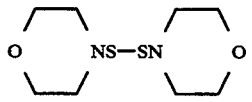

F1

-continued

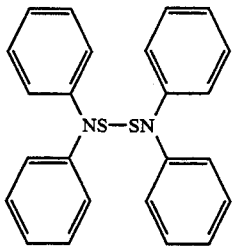

F2

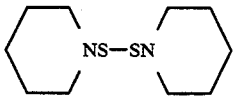

F3

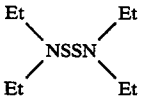

F4

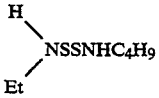

F5

The preparation of these sulfur donors are known to those skilled in the art and many of them are commercially available.

The phosphine compounds of this invention are represented by Formulae I and II shown below, and polymers having a repeating unit derived from the compounds of Formula I.

Formula (I) $R^{18}R^{19}R^{20}P$

Formula (II) $R^{21}R^{22}P—A—PR^{23}R^{24}$ $R^{18}$, $R^{19}$, $R^{20}$, $R^{21}$, $R^{22}$, $R^{23}$, and $R^{24}$ are independently substituted or unsubstituted alkyl, or aryl groups, or $R^{18}$, $R^{19}$, $R^{20}$, $R^{21}$, $R^{22}$, $R^{23}$, and $R^{24}$ may combine to form a 5 or 6-membered ring. A is a divalent carbon group, more preferably an alkyl or aryl group. Preferably, the alkyl groups contain 1 to 18 carbon atoms, with 1 to 6 carbon atoms being most preferred, and the aryl groups contain 6 to 10 carbon atoms, with 6 carbon atoms being most preferred. The most preferred aryl group is a phenyl group. Examples of suitable substituents include alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups, cyano groups, sulfo groups, and amino groups. Most preferably, the phosphine compounds are water soluble.

The more preferred phosphine compounds are those represented by Formula I. Specific examples of phosphine compounds are shown below.

$Bu_3P$ P1

$Ph_2P—(CH_2)_4—PPh_2$ P2

$Ph_3P$ P3

-continued

P4

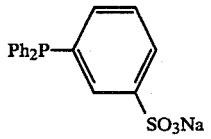

P5

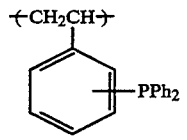

The preparation of the phosphine compounds of this invention is known to those skilled in the art and many of them are commercially available.

The concentration of sulfur donors and phosphine compounds which may be utilized covers a wide range. Because of the variety of structures of the sulfur donors and the phosphine compounds, the levels used will be dependent on the timing of the addition, the layer to which the compounds are added, the type of emulsion and other variables. Those skilled in the art will realize that the balance of the sulfur donor and the phosphine compound needed to achieve optimal heat stability will vary depending on the desired final product. Generally, the useful concentrations of the sulfur donor are from $10^{-5}$ to 10 g/mol silver, more preferably from $10^{-4}$ to 5 g/mol silver, and most preferably from $10^{-3}$ to 1 g/mol silver. Useful concentrations of the phosphine compound are from $10^{-4}$ to 100 g/mol silver, more preferably from $10^{-3}$ to 50 g/mol silver, and most preferably from $10^{-2}$ to 10 g/mol silver. The ratio of sulfur donor to phosphine compound may vary from 1:0.1 to 1:10.

The sulfur donors and phosphine compounds may be added to the photographic emulsion using any technique suitable for this purpose. If the sulfur donors or phosphine compounds are hydrophobic, they may be dissolved in any common organic solvent such as methanol or a mixed aqueous methanolic solution. Examples of other suitable solvents or diluents include ethanol, or acetone. If the sulfur donors or phosphine compounds are water soluble they can be premixed or they can be added separately in aqueous solutions to the emulsion. The sulfur donors and phosphine compounds can also be added to the emulsion in the form of a liquid/liquid dispersion similar to the technique used with certain couplers. They can also be added as a solid particle dispersion.

The sulfur donor and phosphine compound may be added to any layer where they are in reactive association with the silver chloride. By "in reactive association with" it is meant that the sulfur donor and the phosphine compound must be contained in the silver chloride emulsion layer or in a layer whereby they can react or interreact with the silver chloride emulsion. For example, they can also be added to gelatin-only overcoats or interlayers, or to water-only overcoats.

The combination of phosphines and sulfur donor may be used in addition to any conventional emulsion stabilizer or antifoggant as commonly practiced in the art. Combinations of more than one sulfur donor or phosphine compound may be utilized.

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are chemically and spectrally sensitized, as known in the art. Chemical sensitization of the emulsion employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. A temperature rise is employed to complete chemical sensitization (heat treatment). Spectral sensitization is effected with agents such as sensitizing dyes. For color emulsions, dyes are added in the spectral sensitization step using any of a multitude of agents described in the art. It is known to add such dyes both before and after heat treatment.

After spectral sensitization, the emulsion is coated on a support. Various coating techniques include dip coating, air knife coating, curtain coating and extrusion coating.

The sulfur donors and phosphine compounds of this invention may be added to the silver halide emulsion at any time during the preparation of the emulsion, i.e., during precipitation, during or before chemical sensitization or during final melting and co-mixing of the emulsion and additives for coating. Most preferably these compounds are added after chemical sensitization. The sulfur donor and the phosphine compound do not have to be added simultaneously, and they may be added at different points in the preparation of the emulsion. Preferably, the phosphine compound is added first followed by the sulfur donor.

The photographic elements of this invention can be any photographic recording material comprising, at least one high chloride silver emulsion. The other emulsions of the photographic element may have any halide content. For example, the photographic element may also contain silver bromide or silver iodobromide emulsions. The silver chloride emulsion must be comprised of greater than 50 mole percent, and more preferably, greater than 90 mole percent silver chloride.

The photographic elements of this invention can be non-chromogenic silver image forming elements. They can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The element can contain additional layers such as filter layers, interlayers, overcoat layers, subbing layers and the like. This invention may be particularly useful with those photographic elements containing a magnetic backing such as described in No. 34390, *Research Disclosure,* November, 1992.

In the following discussion of suitable materials for use in the emulsions and elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Other suitable emulsions are (111) tabular silver chloride emulsions such as described in U.S. Pat. Nos. 5,176,991 (Jones et al); 5,176,992 (Maskasky et al); 5,178,997 (Maskasky); 5,178,998 (Maskasky et al); 5,183,732 (Maskasky); and 5,185,239 (Maskasky) and (100) tabular silver chloride emulsions such as described in EP 0 534,395, published Mar. 31, 1993 (Brust et al). Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of this invention can include various dye-forming couplers including but not limited to those described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof can contain, among other things, brighteners (Examples in Research Disclosure Section V), antifoggants and stabilizers (Examples in Research Disclosure Section VI), antistain agents and image dye stabilizers (Examples in Research Disclosure Section VII, paragraphs I and J), light absorbing and scattering materials (Examples in Research Disclosure Section VIII), hardeners (Examples in Research Disclosure Section X), plasticizers and lubricants (Examples in Research Disclosure Section XII), antistatic agents (Examples in Research Disclosure Section XIII), matting agents (Examples in Research Disclosure Section XVI) and development modifiers (Examples in Research Disclosure Section XXI).

The photographic elements can be coated on a variety of supports including but not limited to those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image examples of which are described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide elements, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable, and then developed with a color developer. Additionally, the preceding process can be employed but before uniformly fogging the emulsion the remaining silver halide is dissolved and the developed silver is converted back to silver halide; the conventional E-6 process is then continued and results in a negative color image. Alternatively, a direct positive emulsion can be employed to obtain a positive image.

Development is followed by the conventional steps of bleaching, fixing, or bleach-fixing, to remove silver and silver halide, washing and drying.

The following examples are intended to illustrate, without limiting, this invention.

EXAMPLES

EXAMPLE 1

A chemically and red spectrally sensitized monodisperse silver chloride negative emulsion having a cyan dye-forming coupler 2-(α-(2,4-di-tert-amylphenoxy)-butyramido)-4,6-dichloro-5-ethyl phenol (0.42 g/m$^2$) in di-n-butyl phthalate coupler solvent (0.429 g/m$^2$) and gelatin (1.08g/m$^2$) was prepared. In addition, 0.38 g of 1-(3-acetamidophenyl)-5-mercaptotetrazole and 1.1 g of potassium bromide per silver mole were added. The emulsion was divided and various concentrations of a methanolic solution of P3 and a methanolic solution of C3 were added. The emulsion (0.18 g Ag/m$^2$) was coated on a resin coated paper support and 1.076 g/m$^2$ gel overcoat was applied as a protective layer along with the hardener bis (vinylsulfonyl) methyl ether in an amount of 1.8% of the total gelatin weight. The emulsions were then stored at 0° F. and at 140° F. for three days and 0° F. and 120° F. for two weeks.

The coatings were given a 0.1 second exposure, using a 0–3 step tablet (0.15 increments) with a tungsten lamp designed to simulate a color negative print exposure source. This lamp had a color temperature of 3000K, log lux 2.95, and the coatings were exposed through a combination of magenta and yellow filters, a 0.3 ND (Neutral Density), and a UV filter. The processing consisted of color development (45 sec, 35° C.), bleach-fix (45 sec, 35° C.) and stabilization or water wash (90 sec, 35° C.) followed by drying (60 sec, 60° C.). The chemistry used in the Colenta processor consisted of the following solutions:

| | |
|---|---|
| Developer: | |
| Lithium salt of sulfonated polystyrene | 0.25 mL |
| Triethanolamine | 11.0 mL |
| N,N-diethyl amine (85% by wt.) | 6.0 mL |
| Potassium sulfite (45% by wt.) | 0.5 mL |
| Color developing agent (4-(N-ethyl-N-2-methanesulfonyl aminoethyl)-2-methyl-phenylenediaminesesquisulfate monohydrate | 5.0 g |
| Stilbene compound stain reducing agent | 2.3 g |
| Lithium sulfate | 2.7 g |
| Acetic acid | 9.0 mL |
| Water to total 1 liter, pH adjusted to 6.2 | |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach-fix | |
| Ammonium sulfite | 58 g |
| Sodium thiosulfate | 8.7 g |
| Ethylenediaminetetracetic acid ferric ammonium salt | 40 g |

-continued

| | |
|---|---|
| Stabilizer | |
| Sodium citrate | 1 g |
| Water to total 1 liter, pH adjusted to 7.2 | |

The speed at 1.0 density unit was taken as a measure of the sensitivity of the emulsion. Heat sensitivity data was obtained on a sensitometer which was modified with a water jacket so that the temperature of the step tablet could be maintained at 22° C. or increased to 40° C. A 0.1 second exposure was made with a 3000K light source and the coatings were processed with RA-4 chemistry. The change in speed due to the temperature variation (Δ speed) was calculated at the 1.0 density point of the D log E curve and is shown in Table I.

The data in Table I shows the changes in fog (Δ Fog) of the red sensitized emulsion after storage at 0° F. and at 140° F. for three days and 120° F. for two weeks.

TABLE I

| P3 mg | C3 mg | | 3 day 140° F. vs 0° F. | 2 week 120° F. vs 0° F. | Heat Sensitivity 40° vs 22° C. |
|---|---|---|---|---|---|
| Ag mole | Ag mole | Sample # | Δ Fog | Δ Fog | Δ Speed |
| 0 | 0 | 1 (comparison) | 0.22 | 0.33 | 6 |
| 0 | 91 | 2 (comparison) | 0.07 | 0.15 | −3 |
| 0 | 137 | 3 (comparison) | 0.06 | 0.12 | −6 |
| 16 | 0 | 4 (comparison) | 0.19 | 0.29 | 5 |
| 63 | 0 | 5 (comparison) | 0.15 | 0.24 | 8 |
| 16 | 91 | 6 (invention) | 0.08 | 0.15 | −2 |
| 16 | 137 | 7 (invention) | 0.07 | 0.12 | −3 |
| 63 | 91 | 8 (invention) | 0.09 | 0.17 | 2 |
| 63 | 137 | 9 (invention) | 0.07 | 0.14 | 0 |

Samples 1 through 5 are comparisons and samples 6 through 9 are examples of the present invention. It can be seen in samples 2 and 3 that while the A fog is reduced with C3 alone, the a speed change on exposure to heat has gone completely negative, a position equally undesirable as a positive change. Samples 4 and 5 containing the compound P3 show very little fog and heat sensitivity reduction. Samples 6 and 7 and particularly 8 and 9 show the advantages of the combination of P3 and C3 in that they reduce fog growth on incubation and a much lesser change on exposure to high temperature.

EXAMPLE 2

In this example, the beneficial effect of the combination of phosphines and the sulfur donor B1 is seen in a red sensitized emulsion prepared as in Example 1. The emulsions were stored at 0° F. and at 120° F. for one week and two weeks and then exposed and processed as described above. The data in Table II shows the changes in fog (Δ Fog) and heat sensitivity.

TABLE II

| P3 mg | P4 mg | B1 mg | | 1 week 120° F. vs 0° F. | 2 week 120° F. vs 0° F. | Heat Sensitivity 40° vs 22° C. |
|---|---|---|---|---|---|---|
| Ag mole | Ag mole | Ag mole | Sample # | Δ Fog | Δ Fog | Δ Speed |
| 0 | 0 | 0 | 10 (comparison) | 0.12 | 0.38 | 3 |
| 0 | 0 | 12 | 11 (comparison) | 0.10 | 0.32 | −5 |
| 12 | 0 | 0 | 12 (comparison) | 0.12 | 0.38 | 3 |
| 0 | 17 | 0 | 13 (comparison) | 0.12 | 0.39 | 4 |
| 12 | 0 | 12 | 14 (invention) | 0.09 | 0.32 | 1 |
| 0 | 17 | 12 | 15 (invention) | 0.10 | 0.32 | 0 |

It can be seen that the coatings containing the combination of phosphines and a sulfur releasing compound (samples 14–15) have reduced fog increase and less change in speed when exposed at high temperature than either one of the additives by themselves (samples 11–13) or the control (sample 10).

EXAMPLE 3

In this example, the beneficial effect of the combination of phosphine, P4 and the sulfur donor, A1 is seen in a red sensitized emulsion prepared as in Example 1. The emulsions were stored at 0° F. and at 120° F. for one week and two weeks and then exposed and processed as described above. The data in Table III shows the changes in fog (Δ Fog) and heat sensitivity.

TABLE III

| P4 mg | A1 mg | | 1 week 140° F. vs 0° F. | 2 week 120° F. vs 0° F. | Heat Sensitivity 40° vs 22° C. |
|---|---|---|---|---|---|
| Ag mole | Ag mole | Sample # | Δ Fog | Δ Fog | Δ Speed |
| 0 | 0 | 16 (comparison) | 0.65 | 0.35 | 6 |
| 0 | 15 | 17 (comparison) | 0.35 | 0.16 | −5 |
| 25 | 0 | 18 (comparison) | 0.63 | 0.32 | 7 |
| 25 | 15 | 19 (invention) | 0.40 | 0.15 | 0 |

It can be seen that the coating containing the combination of phosphine and a sulfur releasing compound (sample 19) has lower fog increase and less change in speed when exposed at high temperature than either one of the additives by themselves (samples 17–18) or the control (sample 16).

While the invention has been described in detail and with reference to specific embodiments thereof, it will be apparent to one skilled in the art that various changes and modifications can be made therein without departing from the spirit and scope thereof.

What is claimed is:

1. A silver halide photographic element comprising a silver halide emulsion which is greater than 90 mole % silver chloride, said emulsion being in reactive association with a sulfur donating compound and a phosphine compound represented by Formulae I and II, or polymers having a repeating unit derived from the compounds of Formula I, Formula (I) $R^{18}R^{19}R^{20}P$ Formula (II) $R^{21}R^{22}P—A—PR^{23}R^{24}$ wherein $R^{18}$, $R^{19}$, $R^{20}$, $R^{21}$, $R^{22}$, $R^{23}$, and $R^{24}$ are independently alkyl, or aryl groups, or $R^{18}$, $R^{19}$, $R^{20}$, $R^{21}$, $R^{22}$, $R^{23}$, and $R^{24}$ may combine to form a 5 or 6-membered ring, and wherein A is a divalent carbon linking group.

2. The photographic element of claim 1 wherein $R^{18}$, $R^{19}$, $R^{20}$, $R^{21}$, $R^{22}$, $R^{23}$, and $R^{24}$ are independently alkyl groups of 1 to 18 carbon atoms or aryl groups of 6 to 10 carbon atoms.

3. The photographic element of claim 2 wherein the phosphine compound is represented by Formula I.

4. The photographic element of claim 1 wherein the phosphine compound is water soluble.

5. The photographic element of claim 3 wherein $R^{18}$, $R^{19}$, $R^{20}$, $R^{21}$, $R^{22}$, $R^{23}$, and $R^{24}$ are independently alkyl groups of 1 to 6 carbon atoms or phenyl groups and wherein the phosphine compound is water soluble.

6. The photographic element of claim 1 wherein the sulfur donating compound is an aryldialkylamino disulfide, an acylmethylmercapto azolium salt, a 1,2,3,4-thiatriazole, a thiepin, a diamino disulfide or a thiosulfonate salt.

7. The photographic element of claim 1 wherein the concentration of the sulfur donating compound is from $10^{-3}$ to 1 g/mol Ag and the concentration of phosphine compound is from $10^{-2}$ to 10 g/mol Ag.

8. The photographic element of claim 1 wherein the sulfur donating compound is an aryldialkylamino disulfide, an acylmethylmercapto azolium salt, a 1,2,3,4-thiatriazole, a thiepin, a diamino disulfide or a thiosulfonate salt; $R^{18}$, $R^{19}$, $R^{20}$, $R^{21}$, $R^{22}$, $R^{23}$, and $R^{24}$ are independently alkyl groups of 1 to 18 carbon atoms or aryl groups of 6 to 10 carbon atoms; the phosphine compound is water soluble; the concentration of the sulfur donating compound is from $10^{-3}$ to 1 g/mol Ag; and the concentration of phosphine compound is from $10^{-2}$ to 10 g/mol Ag.

9. The photographic element of claim 8 wherein the phosphine compound is represented by Formula I and wherein $R^{18}$, $R^{19}$, $R^{20}$, $R^{21}$, $R^{22}$, $R^{23}$, and $R^{24}$ are independently alkyl groups of 1 to 6 carbon atoms or phenyl groups.

10. A method of making a silver halide emulsion which is greater than 90 mole % silver chloride, comprising precipitating and chemically sensitizing the emulsion and further comprising adding to the emulsion a sulfur donating compound and a phosphine compound represented by Formulae I and II, or polymers having a repeating unit derived from the compounds of Formula I, Formula (I) $R^{18}R^{19}R^{20}P$ Formula (II) $R^{21}R^{22}P—A—PR^{23}R^{24}$ wherein $R^{18}$, $R^{19}$, $R^{20}$, $R^{21}$, $R^{22}$, $R^{23}$, and $R^{24}$ are independently alkyl, or aryl groups, or $R^{18}$, $R^{19}$, $R^{20}$, $R^{21}$, $R^{22}$, $R^{23}$, and $R^{24}$ may combine to form a 5 or 6-membered ring, and wherein A is a divalent group.

11. The method of claim 10 wherein $R^{18}$, $R^{19}$, $R^{20}$, $R^{21}$, $R^{22}$, $R^{23}$, and $R^{24}$ are independently alkyl groups of 1 to 18 carbon atoms or aryl groups of 6 to carbon atoms.

12. The method of claim 11 wherein the phosphine compound is represented by Formula I.

13. The method of claim 10 wherein the phosphine compound is water soluble.

14. The method of claim 12 wherein $R^{18}$, $R^{19}$, $R^{20}$, $R^{21}$, $R^{22}$, $R^{23}$, and $R^{24}$ are independently alkyl groups of 1 to 6 carbon atoms or phenyl groups and wherein the phosphine compound is water soluble.

15. The method of claim 10 wherein the sulfur donating compound is an aryldialkylamino disulfide, an acylmethylmercapto azolium salt, a 1,2,3,4-thiatriazole, a thiepin, a diamino disulfide or a thiosulfonate salt.

16. The method of claim 10 wherein the amount of sulfur donating compound added is from $10^{-3}$ to 1 g/mol Ag and the amount of phosphine compound added is from $10^{-2}$ to 10 g/mol Ag.

17. The method of claim 10 wherein the sulfur donating compound is an aryldialkylamino disulfide, an acylmethylmercapto azolium salt, a 1,2,3,4-thiatriazole, a thiepin, a diamino disulfide or a thiosulfonate salt; $R^{18}$, $R^{19}$, $R^{20}$, $R^{21}$, $R^{22}$, $R^{23}$, and $R^{24}$ are independently alkyl groups of 1 to 18 carbon atoms or aryl groups of 6 to 10 carbon atoms; the phosphine compound is water soluble; the amount of sulfur donating compound added is from $10^{-3}$ to 1 g/mol Ag; and the amount of phosphine compound added is from $10^{-2}$ to 10 g/mol Ag.

18. The method of claim 17 wherein the phosphine compound is represented by Formula I and wherein $R^{18}$, $R^{19}$, $R^{20}$, $R^{21}$, $R^{22}$, $R^{23}$, and $R^{24}$ are independently alkyl groups of 1 to 6 carbon atoms or phenyl groups.

* * * * *

UNITED STATES PATENT AND TRADEMARK OFFICE

CERTIFICATE OF CORRECTION

PATENT NO. : 5,415,992

DATED : May 16, 1995

INVENTOR(S) : Roger Lok

It is certified that error appears in the above-indentified patent and that said Letters Patent is hereby corrected as shown below:

Column 18, lines 16-19,

Claim 11: The method of claim 10 wherein $R^{18}$, $R^{19}$, $R^{20}$, $R^{21}$, $R^{22}$, $R^{23}$, and $R^{24}$ are independently alkyl groups of 1 to 18 carbon atoms or aryl groups of 6 to <u>10</u> carbon atoms.

Signed and Sealed this

Fifth Day of March, 1996

*Attest:*

Bruce Lehman

BRUCE LEHMAN

*Attesting Officer*

*Commissioner of Patents and Trademarks*